United States Patent [19]

Nitsch

[11] 4,005,563

[45] Feb. 1, 1977

[54] HOLDER AND SHEAR LEDGER PLATE FOR PACKAGE TYING MACHINES

[76] Inventor: J. Leonard Nitsch, 101 Park St., Syracuse, N.Y. 13203

[22] Filed: Sept. 24, 1975

[21] Appl. No.: 616,433

[52] U.S. Cl. ..... 53/138 A; 53/198 A; 53/370; 100/31

[51] Int. Cl.[2] ..... B65B 51/08

[58] Field of Search ..... 53/135, 138 A, 198 A, 53/370; 140/93.6; 100/22, 31

[56] References Cited

UNITED STATES PATENTS

| | | | |
|---|---|---|---|
| 3,138,904 | 6/1964 | Burford | 53/135 X |
| 3,242,633 | 3/1966 | Platt, Jr. et al. | 53/135 |

*Primary Examiner*—Travis S. McGehee
*Assistant Examiner*—John Sipos
*Attorney, Agent, or Firm*—Bruns & Jenney

[57] ABSTRACT

A machine in which a bagged product is conveyed to a station where the open end of the bag is tied with a wire reinforced plastic tape ribbon tie. The tying station comprises a wire gripper and cutter, an arcuate needle carrying a tie-supporting roller movable from an initial position in which a length of tie is held in the path of the bag end to a second position with the length of tie looped around the bag end, means for gathering the bag end in a compact neck, and a horizontally disposed hooked twister spaced below the gripper and cutter and rotating about a vertical axis for twisting the loop of tie about the gathered neck of the bag, and the improvement comprises lowering the gripper and cutter to a position in which its lower surface is at substantially the same level as the upper surface of the twister hook.

1 Claim, 8 Drawing Figures

HOLDER AND SHEAR LEDGER PLATE FOR PACKAGE TYING MACHINES

BACKGROUND OF THE INVENTION

This invention relates to a holder and shear ledger plate for package tiers and more particularly to an improved plate for machines described in U.S. Pat. No. 3,138,904, issued June 30, 1964 to E. E. Burford.

Over the years since the issuance of this patent the wire gripper and cutter described in the patent has been modified to a two-piece combination called the holder and shear ledger plate assembly and the machines supplied by the Burford Company to the bakery industry is a machine described in the patent as a modified machine adapted for tying loaves of bread bagged in lightweight packaging material and tied with a length of wire-reinforced plastic or paper tape.

In all of the prior art holder and shear ledger plates of which applicant is aware the holder and shear ledger plate was positioned a substantial distance, of the order of one-fourth inch above the twister hook which twists the wire-reinforced tie ribbon. This often resulted in a wire tie twisted too loosely so that the bag neck was not tied air tight. Modifications were made in the machine to rotate the twister hook four times rather than the three-turn hook described in the patent but frequently the tie was not twisted tight and the twister hook frequently became damaged and bent.

SUMMARY OF THE INVENTION

The present invention contemplates the lowering of the wire holder and shear ledger plate to a position at which its bottom surface is at substantially the level of the top portion of the twister hook. In addition, the bottom surface of the ledger plate is relieved to provide clearance for the passage of the twister hook, the forward end nearest the advancing end of the twister hook is chamfered for rebending an accidentally bent twister hook away from the ledger plate and certain tie-stop parts of the wire holder and shear arm are relieved to allow the tie carried by the needle to approach the ledger plate as closely as possible, all as hereinafter more fully described.

DESCRIPTION OF THE PREFERRED EMBODIMENT

Figure 1:
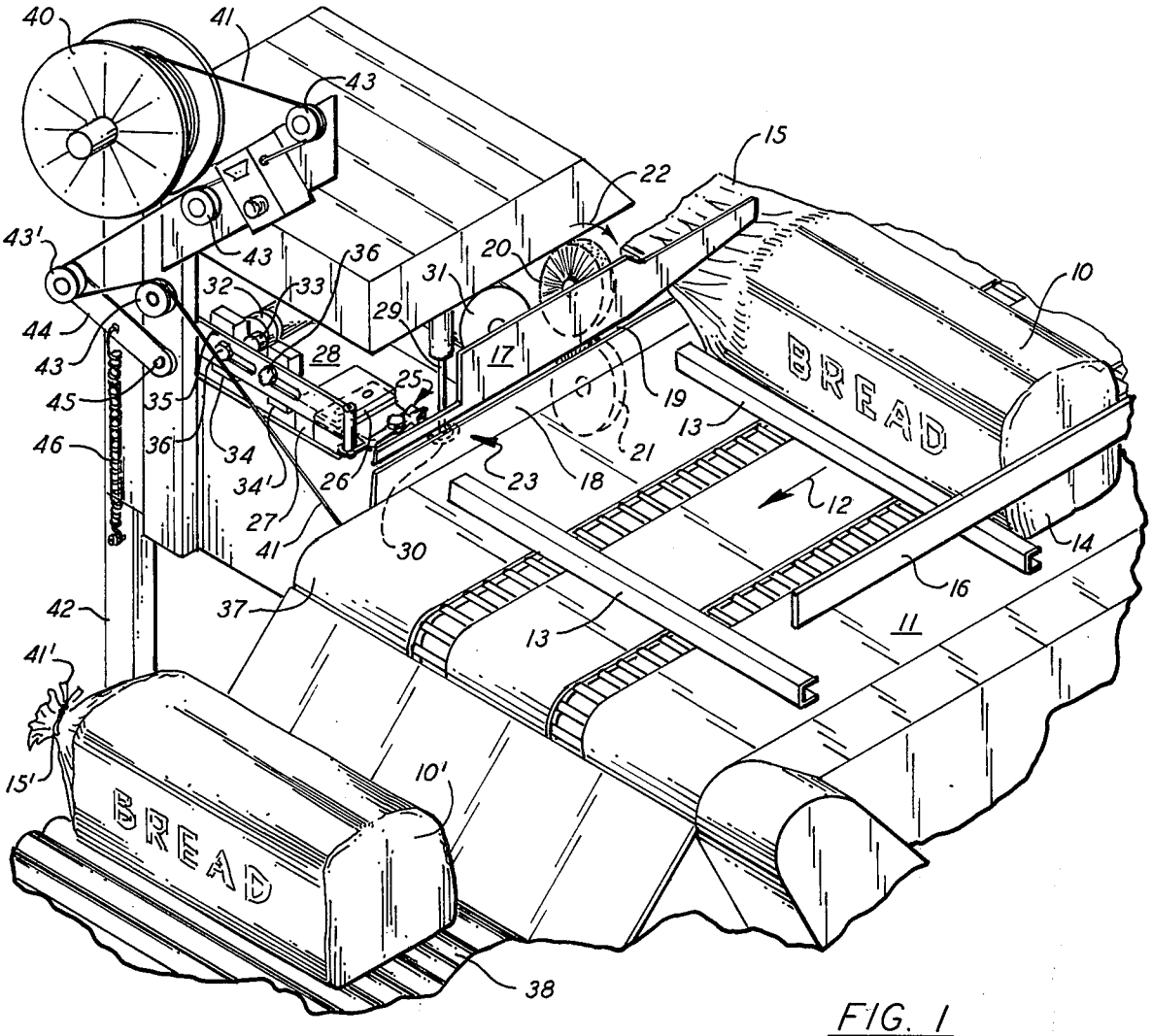
FIG. 1 is a fragmentary perspective view of a portion of a machine embodying the invention.

Referring to FIG. 1, bagged loaves of bread 10 are received on an endless belt conveyor 11 from prior stations where the bread is first sliced and then bagged, and carried in the direction of arrow 12 by drag links 13 secured to the belt 11, the links being spaced for separating the loaves. Each loaf bag has a closed end 14 and an open or neck end 15. The closed ends are guided by guide rail 16 adjustably secured on the conveyor 11, by means not shown, and the neck ends are guided by a spaced pair of guide plates 17 and 18, separately supported and having a horizontally extending slot 19 therebetween. Slot 19, at the end at which the bags enter, has a tapered mouth by reason of this end of the upper plate 17 having its lower edge tapered upwardly toward the entrance and the end of the lower plate 18 having its upper edge tapered downwardly.

As the bagged loaves 10 are carried forward by conveyor 11, the slot 19 guides the open end or neck of each bag between two oppositely rotating brushes 20 and 21, the direction of rotation of the upper brush 20 being indicated by the arrow 22. The parallel axes of rotation of the brushes is at an angle of substantially 45° to the slot 19 so that the loaves are pulled against the plates 17 and 18 and the necks 15 of the bags are gathered and urged toward the tying station indicated generally at 23.

At the tying station, a holder and shear ledger plate assembly 25, hereinafter described, is supported underneath a horizontally projecting flange 26 of upstanding pillar 27 secured to a floor plate 28 at this station. It will be understood that the floor 28 is spaced from guide plate 18 to provide for passage of parts to be described.

Adjacent the approach end of assembly 25, a vertical shaft 29 is rotatably supported from above and has at its lower end a C-shaped twister hook 30, hereinafter described, the twister hook being below the assembly 25, as shown. Adjacent shaft 29, a motor 31 for operating the brushes is shown and means, not here shown but shown and described in aforesaid U.S. Pat. No. 3,138,904, are provided for intermittently and in a sequence to be later described, to rotate at selected times both shaft 29 and a shaft 32 which has an offset pin 33 at its end. The pin 33 operates to alternatively strike the block 34 or block 34', each block being adjustably secured on a slide lever 35, by a screw 36 passing through an adjusting slot in lever 35 and threaded into the respective block. One end of lever 35 is rotatably secured to an end of a holder and cutter arm of assembly 25 as will appear.

The endless belt conveyer ends at 37 and a bagged loaf 10' is shown, wrapped and tied at 15', on a removal conveyor 38.

A spool 40 of wire-reinforced tying ribbon 41 is rotatably supported but suitably braked on a machine frame support member 42. The ribbon 41 is led over a plurality of rollers 43 to mechanism to be described underneath station 23 and brushes 19 and 20, one roller 43' being shown rotatably supported on a ribbon tensioning arm 44 pivotally supported at 45 to a portion of frame 42. A coil spring 46 is shown for applying tension at all times to the ribbon 41.

Figure 2:
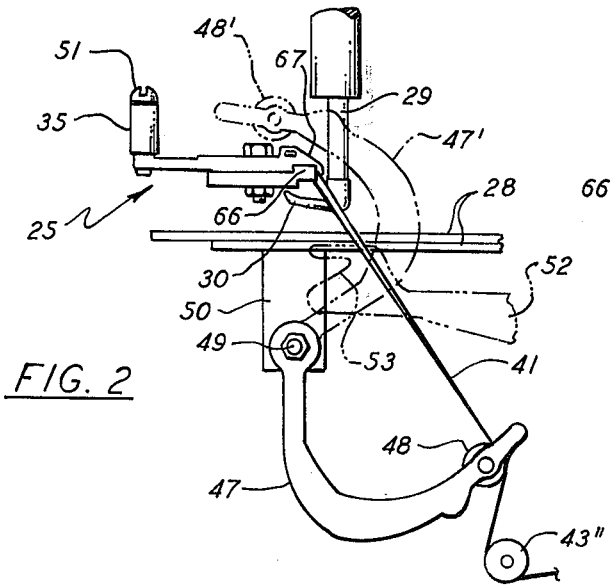
FIG. 2 is a fragmentary, diagrammatical, side-elevational view of a portion of the machine of FIG. 1 at the bag-tying station and showing the tie holder and shear ledger plate assembly, the twister mechanism and the tie-carrying needle in its bag receiving position in full lines, and showing the needle substantially in its initial bag-tying position and a neck gathering and compacting plunger in its bag-neck-gathering position in phantom lines.

Referring to FIG. 2, a curved or C-shaped needle 47 is shown in its normal and unoperated position in full lines below the assembly 25, twister 30, and floor 28. Needle 47 carries a roller 48 at its free end, the other end being secured on the end of a shaft 49 journalled in a support 50 pendantly secured to floor 28. It will be understood that the tape 41 from the spool 40, shown in FIG. 1, is carried under tension on a plurality of rollers 43 to the roller 43'', shown in FIG. 2, from whence it passes over roller 48 to where it is gripped between the jaws of assembly 25. The end of lever 35 is shown secured by a shouldered screw 51 to the gripper arm of assembly 25.

Also shown in FIG. 2, in phantom lines, are the needle 47' rotated by rotation of shaft 49 to an elevated position substantially at its fully operated position and a gathering plunger 52, diagrammatically shown, having a throat portion 53 adapted to gather the neck portion 15 of a bag and force it against the taut ribbon 41 when the plunger is advanced as hereinafter described.

Figure 3:
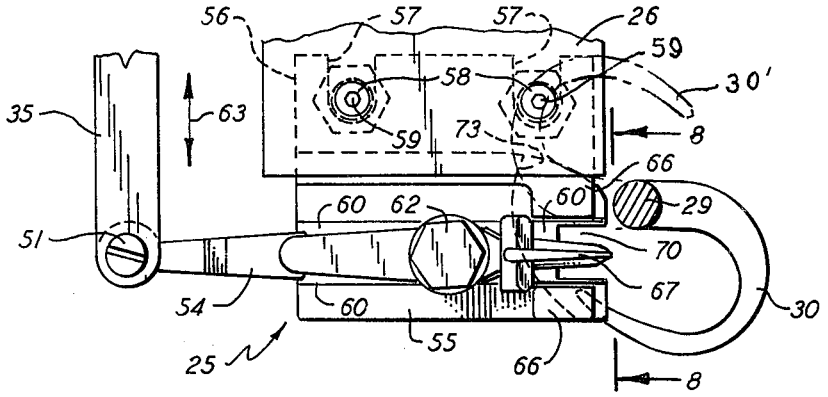
FIG. 3 is an enlarged plan view of the holder and shear ledger plate assembly of the present invention and showing the twister hook partially in section, the hook being shown rotated to its rest or initial position in phantom lines.
Figure 4:
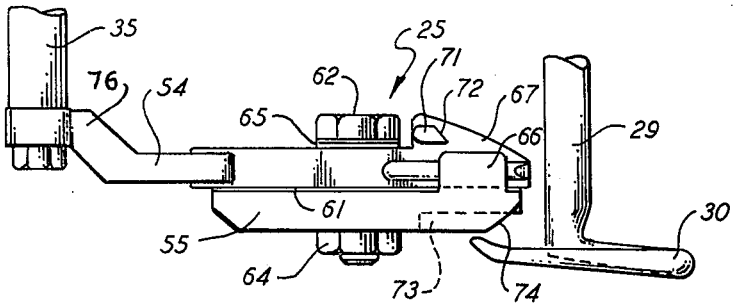
FIG. 4 is a fragmentary side elevational view thereof.
Figure 5:
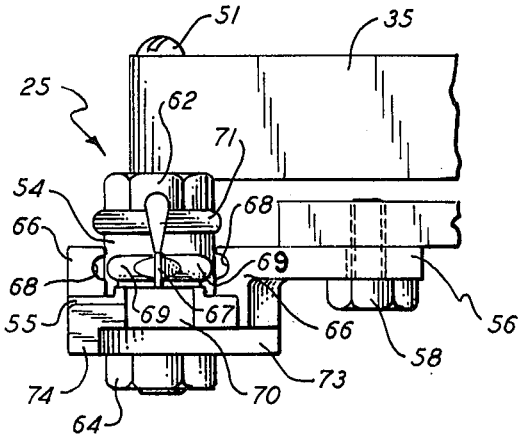
FIG. 5 is a further enlarged end-elevational view of the holder and shear ledger plate and associated parts.

Referring now to FIGS. 3, 4 and 5, the holder and shear ledger plate assembly 25 of the invention comprises a movable holding and shearing or cutting arm 54 and a stationary or ledger shearing plate 55. The plate 55 has a laterally projecting flat attaching flange 56, best seen in FIG. 5, and flange 56 is provided with two slots 57, best seen in FIG. 3, for the reception of bolts 58 by which assembly 25 is adjustably secured to the flange 26 at the station 23. Bolts 58 are provided with hexagonal sockets 59 at their upper ends so that they can be conveniently and quickly secured from above by means of allen-head wrenches.

It will be understood that the arm 54 is arbitrarily shown in FIGS. 3 and 5, midway between alternate positions for reasons of clarity. The upper surface of plate 55, denoted 60 in FIG. 3, and the lower surface of arm 54, denoted 61 in FIG. 4, are ground smooth and flat and arm 54 is pivotally secured to the plate 55 by a pivot bolt 62 so that arm 54 may be quickly moved from one alternate position to the other by lever 35 as indicated by the arrows 63 in FIG. 3. Bolt 62 is provided with a mating nut 64 as shown in FIG. 4 and parts 54 and 55 are held firmly together by three dished spring washers at 65.

It will be noted that the plate 55 is provided with upstanding portions 66 serving as stops for the nose 67 of arm 54, the inner sides of portions 66 having semicircular grooves 68 therealong, as best seen in FIG. 5, and the angularly tapered nose 67 of arm 54 having complementary semicircular flanges 69 therealong adapted to grip a portion of the tying ribbon 41 therebetween as jaws when arm 54 is turned to either one of its alternative positions. It will also be noted that the nose 67 of arm 54 in FIG. 3 overlies a rectangular vertically extending groove or cut-out 70 in the plate 55. Since the flat ground surface 60 on top of plate 55 extends on either side of cut-out 70 and the lower flat portion 61 of arm 54 extends along the bottom of nose 67, it will be apparent that any portion of tying tape 41 lying in cut-out 70 will be cut apart or sheared when the arm 54 is swung from one of its alternate positions to the other. Preferably the surfaces 60 and 61 and the cutting edges are carbide hardened.

Figure 8:
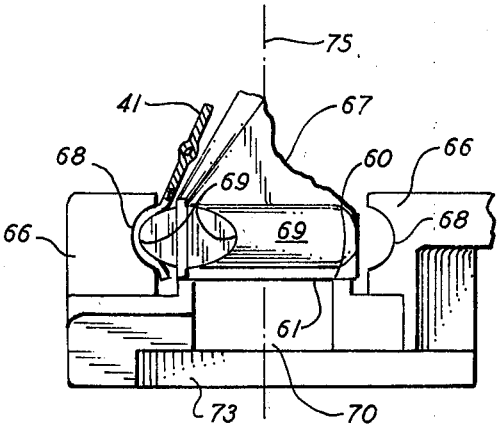
FIG. 8, on sheet 1 of the drawings, is a diagrammatic, fragmentary, enlarged end view, as viewed from the arrows 8—8 of FIG. 3, of the front portion only of the holder and shear ledger plate, showing the end of a tie partially in section gripped by the holder arm at one side.

Referring now to FIG. 8, the nose 67 of arm 54 is shown in one of its alternate positions, the one shown in FIG. 2 for instance, the semi-circular flange 69 of nose 67 and the semi-circular groove 68 in projection 66 gripping or holding between them a severed end of a tie wire 41, the tie wire being shown in section above the nose 67. It will be understood that tie wire 41 is bent sharply, at the point it is shown in section, downward by reason of the tensioning device 44–46 (FIG. 1) toward roller 48 on needle 47 as shown in full lines in FIG. 2. The axis of pivot of arm 54 is indicated by the broken line 75.

When needle 47 is turned by shaft 49 to its position shown in phantom lines in FIG. 2 the ribbon tie is carried up and around the gathered end 15 of a bag in more or less gathered condition under the nose 67 and under the twister 30. The twister hook being at its rest position as shown at 30' in FIG. 3, the ribbon or tie, held at one end between curved surfaces 68 and 69, as shown in FIG. 8, is carried in a loop up and over the neck of the bag, now gathered by the throat 53 of plunger 52 which, by this time, has carried the gathered neck against the portion 41 of the tie shown in FIG. 2. As needle 47' moves to its extreme operated position the other end of the tie or ribbon 41 is carried by roller 48' up and around the gathered neck and into the cut-out portion 70 of plate 55 and to the right of nose 67 in FIG. 8. When the arm 54 is moved to its other alternate position, the tie wire 41 to the right of nose 67 is cut by the shearing surfaces 61 and 60 of the arm and of the plate adjacent cut-out 70.

Figure 6:
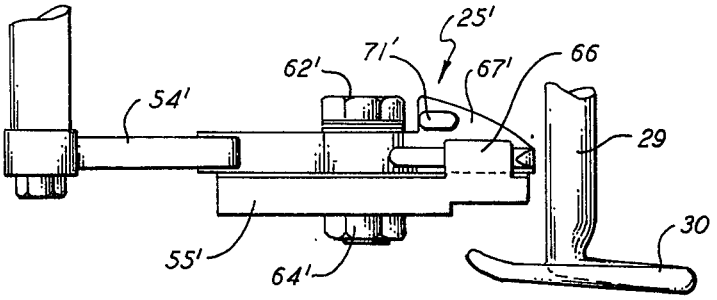
FIG. 6 Prior Art
FIG. 6 is a view similar to FIG. 4
Figure 7:
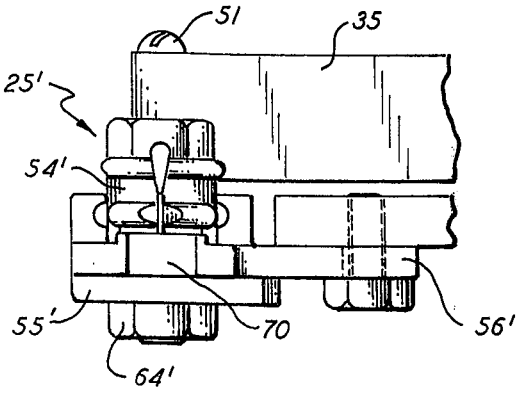
FIG. 7 Prior Art
FIG. 7 is a view similar to FIG. 5 of the holder and shear ledger plate and associated parts of the prior art.

Referring now to FIGS. 6 and 7 and comparing them to the similar FIGS. 4 and 5, respectively, it will be noted that tie-stop portions 71' of the prior art device have been cut away at their front or approach side and given an upward and rearward sloped face or bevel at 72 as shown in FIG. 4.

The assembly 25 of FIG. 5 has been effectively lowered one-fourth inch as best seen in FIGS. 5 and 7, the attaching flange 56 of FIG. 5, having been offset upward from its prior art position 56' shown in FIG. 7. The lowering of assembly 25 is shown in FIG. 4 as lowering the bottom surface of plate 55 to substantially the upper surface of the twister hook 30.

Moreover, the bottom surface of plate 55 has been arcuately relieved on its bottom surface at its forward or approach end as shown at 73 in FIG. 5, the arcuate nature of the relief being shown at 73 in FIG. 3 in broken lines. The approach end of plate 55 has been given a downwardly and rearwardly bevelled face at 74, as best seen in FIG. 4, and as shown at the left in FIG. 5, for bending downward again the advancing or pointed end of twister hook 30 which may have become bent upward and outward accidentally.

Moreover the trailing end of the arm 54 has been offset upwardly one-fourth inch by flange 76 so that no change in the machine need be made except those changes embodied in the holder and shear ledger plate assembly itself.

Referring gain briefly to FIG. 1, it will be understood that there is a first switch, not shown, having an operating arm in the path of neck 15 as it advances to brushes 20–21 and a second switch, not shown, with an operating arm between the brushes and station 23. The first switch is a trip switch which is normally closed and the second switch is a normally open limit switch and both are in a circuit which operates a solenoid initiating action of the parts at station 23.

When a bag neck 15 operates the first switch the circuit is opened and when it operates the second switch the circuit through the switch is closed but is not operative until the bag neck leaves the first switch which then closes to operate the circuit to a solenoid which initiates the clutch and drive mechanisms described in U.S. Pat. No. 3,138,904.

With the operation of the clutch mechanism the gathering plunger 52 comes up quickly behind the neck of the package and carries the neck forward at a speed exceeding that of the conveyor 11, gathering the neck into a bundle at the throat 53 and forcing it against the taut length of tie ribbon at 41 shown in FIG. 2. The needle 47 then comes up and around the gathered neck carrying the length of tie 41 adjacent the needle roller 48 in a loop around the neck, one end of the loop being secured between the portion 66 of the plate and the rounded flange 69 on the nose 67 of arm 54, as shown in FIG. 8, the other end of the loop being carried into cut-out 70 and between the flange 69 on the other side of nose 67 and its adjacent portion 66 of the plate. Movement of the needle ceases when it reaches the position indicated in broken lines at 47' in FIG. 2.

At this point the arm 54 moves sharply to its other position with nose 67 against the other portion 66 of the plate shearing the tie 41 and gripping the tie between portions 69 and 66 in this other position.

By this time the twister hook 30 has completed a portion of its first revolution from its initial position shown at 30' in FIG. 3, to a point where it has engaged and bent the portion of tie 41 engaged in the jaws of assembly 25 as shown in FIG. 2 and the loop of tie is supported on the hook 30 while the arm 54 abruptly shifts position shearing the tie and the severed loop of tie is thereafter supported by hook 30.

The twister hook continues its rapid rotation thereafter, twisting the loop of tie 41 now supported solely by the twister hook 30. After three revolutions the twister hook stops again in the position shown at 30' in FIG. 3 and a stripper lever, not shown but having one end pivotally supported on floor 28 shown in FIG. 2, is swept horizontally under the hook 30 carrying the now-tied neck forward toward removal conveyor 38.

The stripper lever returns to its rest position, the gathering plunger 52 returns to its rest position, and needle 47 returns to its full line position shown in FIG. 2 and the parts at station 23 have completed their cycle. It will be understood that at the next cycle the loop of tie 41 has one end supported by the jaws of assembly 25 in its alternate gripping position until arm 54 is again shifted and the jaws return to the position shown in FIG. 8.

As shown in FIGS. 3, 4 and 5, and comparing them with FIGS. 6 and 7, it will be seen that the shear and ledger plate assembly 25 has been lowered one-fourth inch by offsetting the attachment flange 56 upward one-fourth inch. Since the two ends of the loop of tie carried by needle 47 are sheared at the level of surfaces 60 and 61, which have been lowered one would expect a savings of one-half inch of tie. Actually, it has been found that the savings in tie amount to over seven-eighths of an inch in most instances where the holder and shear ledger plate of the present invention have been installed and a much tighter twisting of the tie has been effected rendering the twisted tie airtight. In bakery installations wrapping thousands of loaves per hour, the savings is considerable and the tightness of the twist amounts to a savings in the freshness of the wrapped loaves.

The arcuate relief of the shear plate bottom at 73 and the downwardly slanted relief of the plate at 74 are believed to make the present invention feasible and this savings possible and the hexagonal recesses 59 in the upper ends of the attaching bolts 58 make the replacing of an assembly 25 much quicker and more convenient.

I claim:

1. In a bag tying machine in which an endless conveyer belt carries bagged loaves of bread past a tying station with means for guiding the open end of each bag toward the tying station and bunching it into a neck, a reel carrying a supply of wire-reinforced tie ribbon adjacent the tying station, the ribbon being led over a series of rollers to a needle carried roller, tie tensioning means connected to the supply reel, a tie holder and shear ledger plate assembly at the tying station, the assembly having a holder and shear arm pivotally secured to the stationary plate, the plate having a cut-out portion at its approach end for access therethrough for the tie ribbon and having shear edges and holding projections at either side, the arm having at its approach end an angularly tapered nose having on either side a shear edge and a holding projection adapted to cooperatively engage the shear edge and holding projection of the plate on either side, machine means for moving the arm from side to side, support means at the tying station including a horizontally projecting support flange, a twister rotatably supported from above at the tying station, the twister having a horizontally disposed C-shaped hook adapted to underlie the plate and adapted to twist a loop of tie passing through the cut-out portion of the plate when the hook is rotated, means for rotating the hook, a vertically disposed C-shaped needle carrying the needle roller on its free end normally disposed under the twister hook and over which the tie ribbon passes to a sheared end held between a holding projection of the plate and the adjacent holding projection of the arm nose when the arm is moved to one side, the other end of the needle being secured to a horizontally disposed shaft, means for compressing the bag neck into a tubular configuration under the twister hook and forcing the neck against the tensioned length of tie ribbon extending from the ledger plate approach end to the needle roller, means for rotating the needle shaft to move the free end of the needle and its tie-carrying roller up and over the cut-out portion of the ledger plate, the nose having tie-stop portions on either side to contact the tie adjacent its roller; timing means initiated by the passing of each bag open end for rotating the twister hook, rotating the needle shaft, operating the neck compressing means, and after a delay, moving the holder and shear arm from one side to the other for cutting the length of tie around the bag neck and holding the sheared end of the tie for the next cycle of the tying operation; the improvement comprising: the ledge plate having an integral upwardly projecting flange connected to said support flange and which offsets the ledger plate downward to distance for lowering the ledger plate to a level at which its bottom surface is substantially at the level of the upper surface of the twister hook, the holder and shear arm having a flange that offsets the trailing end of the holder and shear arm upward a like distance for connection with its moving means, the bottom surface of the ledger plate having an arcuate relieved portion for clearance above the twister hook, and the approach end of the ledger plate being beveled downward and toward its trailing end for deflection of an accidentally bent twister hook.

* * * * *